US008066027B2

(12) United States Patent
Sprague

(10) Patent No.: US 8,066,027 B2
(45) Date of Patent: Nov. 29, 2011

(54) VACUUM ACTIVATED CLOSED LOOP SYSTEM

(76) Inventor: Alden C. Sprague, Huntington Station, NY (US)

( * ) Notice: Subject to any disclaimer, the term of this patent is extended or adjusted under 35 U.S.C. 154(b) by 0 days.

(21) Appl. No.: 12/509,443

(22) Filed: Jul. 25, 2009

(65) Prior Publication Data

US 2010/0071780 A1 Mar. 25, 2010

Related U.S. Application Data

(63) Continuation of application No. 61/084,790, filed on Jul. 30, 2008.

(51) Int. Cl.
*F16L 43/00* (2006.01)

(52) U.S. Cl. ..... 137/128; 137/124; 137/143; 137/147; 261/122.1

(58) Field of Classification Search ..... 137/124, 137/128, 142, 143, 145, 140, 146, 147; 261/76, 261/104, 107, 122.1, DIG. 75
See application file for complete search history.

(56) References Cited

U.S. PATENT DOCUMENTS

| | | | | | |
|---|---|---|---|---|---|
| 2,401 | A | * | 12/1841 | Johnson | 137/142 |
| 56,597 | A | * | 7/1866 | Naglee | 137/143 |
| 298,805 | A | * | 5/1884 | Weeden | 137/128 |
| 378,811 | A | * | 2/1888 | Tyler | 137/128 |
| 475,396 | A | * | 5/1892 | Hawley | 137/128 |
| 853,705 | A | * | 5/1907 | Lindenberg et al. | 137/128 |
| 2,063,002 | A | | 12/1936 | Smith | |
| 3,505,688 | A | * | 4/1970 | Sloan | 137/124 |
| 3,510,884 | A | * | 5/1970 | Sloan | 137/124 |
| 3,939,523 | A | | 2/1976 | Kolbe et al. | |
| 3,945,211 | A | | 3/1976 | Rowe | |
| 3,956,124 | A | | 5/1976 | Fast et al. | |
| 4,051,204 | A | * | 9/1977 | Muller et al. | 261/DIG. 75 |
| 4,110,058 | A | | 8/1978 | Langle et al. | |
| 4,124,035 | A | | 11/1978 | Rice | |
| 4,132,247 | A | | 1/1979 | Lindberg | |
| 4,180,976 | A | | 1/1980 | Bunn | |
| 4,301,826 | A | | 11/1981 | Beckerer | |
| 4,396,842 | A | * | 8/1983 | Jhun | 290/42 |
| 4,587,435 | A | | 5/1986 | McCullough | |
| 4,617,113 | A | * | 10/1986 | Christophersen et al. | 261/122.1 |
| 4,624,109 | A | | 11/1986 | Minovitch | |
| 4,743,405 | A | * | 5/1988 | Durao et al. | 261/76 |
| 4,807,674 | A | | 2/1989 | Sweet | |
| 5,034,164 | A | * | 7/1991 | Semmens | 261/122.1 |
| 5,356,076 | A | | 10/1994 | Bishop | |
| 5,507,943 | A | | 4/1996 | Labrador | |

(Continued)

*Primary Examiner* — Craig Schneider
*Assistant Examiner* — Craig J Price
(74) *Attorney, Agent, or Firm* — Stanley H. Kremen

(57) ABSTRACT

The Present Invention enables energy to be extracted from the atmosphere by creating a vacuum into which atmospheric air is drawn through a vacuum operated motor. The motor operates on the pressure differential between atmospheric pressure at the motor inlet and the vacuum level created by liquid flowing vertically through a tube via gravity. The greater the pressure differential, the greater the airflow through the motor, and the greater the energy extracted by the vacuum motor. The Present Invention is a workable and sustainable vacuum energy recovery system based on siphon principles, and specifically addresses problem areas immediately identifiable to a siphon-based system with air infusion. A scavenger loop operates independently to prevent air and/or gas from accumulating at the siphon apex. Micro-diffusers designed for sweeping effects across the air-liquid interfaces also provide for the optimal ratios of air volumes and bubble sizes compatible with the liquid flow rates within a given siphon. Additional flow controlling valves are not required.

7 Claims, 6 Drawing Sheets

U.S. PATENT DOCUMENTS 5,674,433 A * 10/1997 Semmens et al. ..... 261/122.1
5,970,999 A 10/1999 Greenia
6,239,505 B1 5/2001 Kao
6,800,115 B2 10/2004 Eimer
6,967,413 B2 11/2005 Atiya
6,984,304 B2 1/2006 Andrews et al.
7,063,247 B1 6/2006 Lund et al.
7,537,200 B2 * 5/2009 Glassford ..... 261/104
2005/0230856 A1 * 10/2005 Parekh et al. ..... 261/122.1
2006/0144439 A1 * 7/2006 Bell ..... 137/147

* cited by examiner

VACUUM ACTIVATED CLOSED LOOP SYSTEM

CROSS REFERENCE TO RELATED APPLICATIONS

This Present Application is the non-provisional counterpart of U.S. Provisional Application Ser. No. 61/084,790 filed on Jul. 30, 2008. Said Provisional Application is incorporated by reference herein in its entirety. This Present Application claims the benefit of and priority to said Provisional Application.

BACKGROUND OF THE INVENTION

An examination of the relevant prior art discloses that the complex relationships related to volume and velocity of liquid flow in a siphon, the volume and bubble sizes of the entrapped air with the resulting changes in density are significantly oversimplified and expressed mathematically or in terms of total air in the liquid. In addition, the positioning of the air insertion plates pointing downward from the apex of the siphon ignores the propensity for bubbles to agglomerate and rise from the entry point in the absence of an adequate sweeping effect from liquid flowing directly across the interfacing surface. No means has ever been described for removing any pockets of air and/or gas that could accumulate. The air plate at the apex entry point also refers to "small holes" for producing small bubbles without regard for any degree of the actual hole size necessary for producing sufficiently small bubbles or to any procedure for attaining same. It is furthermore unclear from the prior art as to how the transition from priming the siphon system to the introduction of air bubbles through the top air plate while maintaining the prime and elevating the apex air entry point above 10 m can be accomplished without manipulating the basic laws of physics. The most relevant prior art examined to date appears not to be workable as presented.

A prime example of such a disclosure of an attempt to solve the problem and the closest prior art to the Present Invention is U.S. Pat. No. 4,396,842 issued to Bonghan Jhun on Aug. 2, 1983 (hereinafter "Juhn"), entitled "Tidal Power Generation Utilizing the Atmospheric Pressure." Juhn relies on a dam 14 to create two different water levels on either side, and places an inverted U-structure 20 (shown with perpendicular corners) on either side of the dam. The problem of running a siphon of this type with rapidly flowing liquid is that air tends to accumulate at the top of the structure. Very small bubbles will be carried away with the downflowing liquid. Recognizing the need for the air intake 32 to be broken into small bubbles, Juhn places a plate 40 with small holes 41 at the exit 33 of the air tube 30. However, the liquid downflow velocity must be sufficiently high to carry the air bubbles away. Juhn places his air intake at the top of the structure, a place where the downflow velocity is low. Juhn's porous plate does not work because it is at the apex of the structure. The bubbles will not diffuse through the liquid. In addition, Juhn is silent regarding the diameters of the holes in the plate. The bubbles must be extremely small. Furthermore, the horizontal length of the U-structure top 21, 22, is relatively long. Air would tend to accumulate along the inside top 22 of the structure. The air 32 flows only in one direction, i.e., into the structure. Eventually, enough air accumulates in the top chamber to kill the siphon effect. Juhn also uses a valve 11 to control the liquid flow velocity. This slows down the downflow, thereby causing more air accumulation. Finally, Juhn makes no provision for priming the system. As disclosed by Juhn, it is doubtful that his system would function as described.

Approach To Solving The Problem

Juhn's porous plate positioned at the top of the structure will cause accumulation of air in the structure. This will eventually shut down the siphon. Also, the bubbles must be small enough to be carried away with the downflow. They must be micro-bubbles. The Present Invention inserts a micro-bubble diffuser into the downstream flow where the downflow velocity is sufficient to carry the bubbles away. The diameters of the porous openings should be in the order of five microns, and no greater than ten microns. To create such small bubbles, the micro-bubble diffuser comprises either a hydrophobic membrane or multiple tubules having diameters less than or equal to ten microns.

The first embodiment uses a hydrophobic microporous membrane. The microporous membrane is a thin, planar or cylindrical sheet of polymeric material containing a very large number of microscopic pores. These membranes are available in both hydrophilic (water filtering) and hydrophobic (water-repellent) forms. Hydrophobic membranes block liquids, while allowing air to flow through the membrane. Currently, PTFE (polytetrafluoroethylene), polypropylene, PVDF (polyvinylidene difluoride), and acrylic copolymer are mostly used to produce these membranes. These polymers undergo special treatment to exhibit the desired surface characteristics.

The second embodiment uses multiple tubules having inside diameters less than or equal to ten microns. These microtubules extend into the downstream flow in a direction perpendicular to the flow. They are flexible, and they bend in the direction of the flow.

The Present Invention uses a vacuum pump to prime the siphon. Once the flow starts, the priming pumping action discontinues. Furthermore, at least one parallel siphon system acts as a scavenger loop to prevent air from accumulating at the apex of the system.

Juhn uses flow regulating valves to control the flow of both air and water. The Present Invention uses valves only for starting and isolating systems. The Present Invention does not require valves to regulate the flow of liquid, because the air flow would suffer a loss of pressure if valves were used to restrict air flow.

Juhn does not address how to dispose of floatables and other debris that undoubtedly collects over time. This problem is handled by the scoop action at the entrance to the scavenger columns.

SUMMARY OF THE INVENTION

The Present Invention enables energy to be extracted from the atmosphere by creating a vacuum into which atmospheric air is drawn through a vacuum operated motor. The motor operates on the pressure differential between atmospheric pressure at the motor inlet and the vacuum level created by liquid flowing vertically through a tube via gravity. The greater the pressure differential, the greater the airflow through the motor, and the greater the energy extracted by the vacuum motor.

The design features unique to the Present Invention that are paramount to a workable and sustainable vacuum energy recovery system based on siphon principles specifically address problem areas immediately identifiable to a siphon-based system with air infusion. In the Present Invention, a scavenger loop operates independently to prevent air and/or gas from accumulating at the siphon apex. Micro-diffusers designed for sweeping effects across the air-liquid interfaces also provide for the optimal ratios of air volumes and bubble sizes compatible with the liquid flow rates within a given siphon. Additional flow controlling valves are not required.

DETAILED DESCRIPTION OF THE INVENTION

Figure 1:
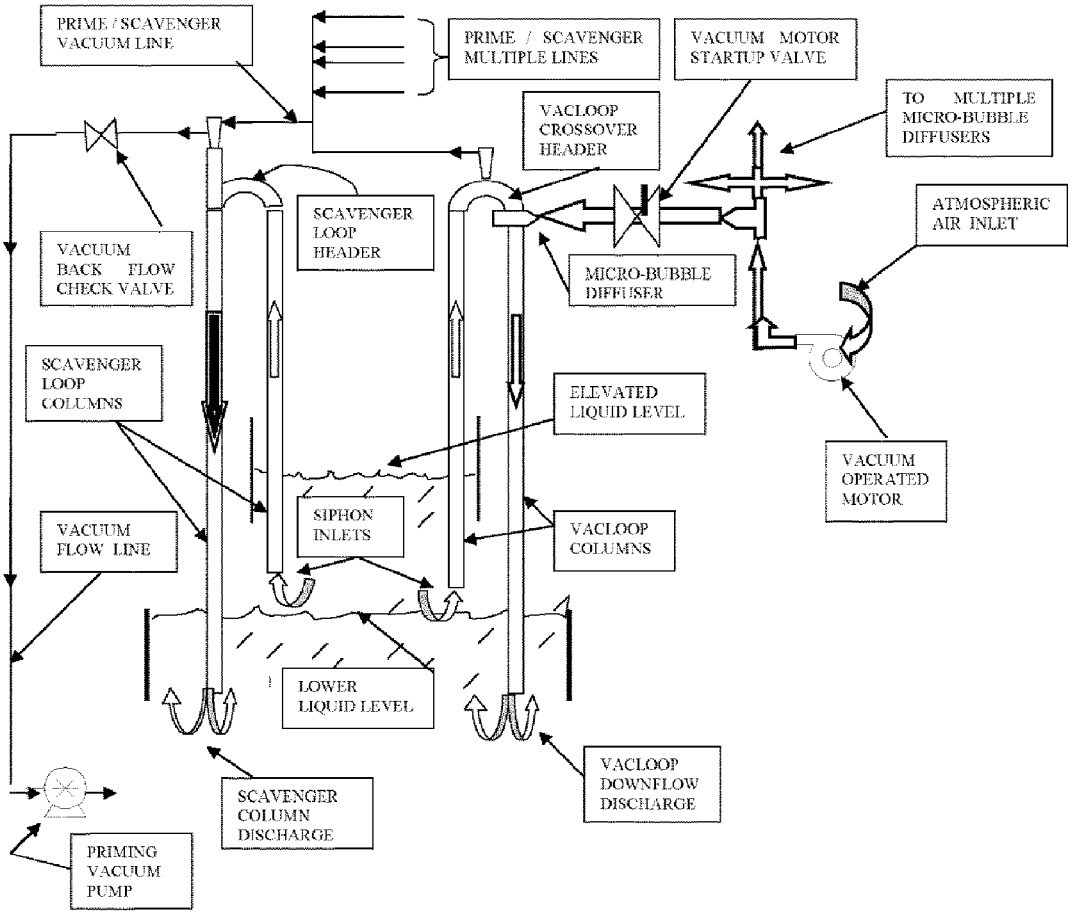
FIG. 1 Typical process flow diagram for the first embodiment of the Present Invention.

The Present Invention enables energy to be extracted from the atmosphere by creating a vacuum into which atmospheric air is drawn through a vacuum operated motor. The vacuum is created by water flowing at high speeds through a pipe. The water flows continuously based on the siphon effect. As the water flows past an air inlet positioned perpendicular to the direction of flow, air is drawn into the water column. If a vacuum motor is connected to the air inlet, the rotor spins. A windshield wiper motor is a typical vacuum motor. Energy is then generated by a vacuum motor connected to the air inlet when the vacuum is applied. Vacuum energy is converted therein to mechanical movement via a pivoting piston.

The Present Invention is fail-safe in that it would shut down from an incident causing loss of vacuum. Residual water would gravity drain. There would be no pressure, water or air related problems. The Present Invention is highly maintainable in that components critical to operation are positioned above water surfaces and are easily accessible. Transparent materials of construction may be used to enable visual observation of micro-diffuser operations. The Present Invention is highly flexible in that systems are composed of units, which can be assembled as modules and scaled up to increase capacity as desired. The Present Invention is designed to handle solids in that inside diameters of components, which carry flowing water, contain no obstructions to flow and can be sized to pass any solids present in the flowing medium. The Present Invention is corrosion resistant in that components, which are exposed to potentially corrosive liquids, can be fabricated from materials resistance to those elements (e.g., saline or brackish water). The mechanical motors, which operate on a vacuum, receive filtered atmospheric air, not liquids at the inlets. The negative pressure-operating mode of the Present Invention permits fabrication using the lighter weight thin wall materials of construction. Lightweight plastics can be considered. The startup procedure requires an outside vacuum source for priming. Once primed and steady state operation is confirmed, the startup vacuum is discontinued. The Present Invention will operate in a self-sustaining mode once steady-state operation is attained, and the low energy source remains constant. No additional control is needed following startup in achieving steady-state operation.

Overall costs for the Present Invention can be significantly competitive. Most components and materials are commercially available. Fabrication using low weight materials lead to reduced transportation, assembly, foundation, and maintenance costs.

Installations of the Present Invention can be structured for minimal environmental impact with regard to a selected source of low energy potential. An offshore site for harvesting tidal or wave/surf energy could be selected accordingly. A portion of the water could be diverted from a stream or river to supply the Present Invention and then returned at a point slightly downstream, thus eliminating the need for a full dam structure, which would alter the natural characteristics of the main stream. In addition, the aerating effects inherent in the Present Invention operation would actually enhance water quality in a side stream. Multiple side streams are possible because the modular design of the Present Invention would accommodate multiple installations positioned at varying elevations. Modules could then be connected in parallel to supply vacuum flow as a single unit to a single vacuum motor. Depending upon the source of water supply, and allowing for sufficient upstream elevation, the Present Invention could be installed as a series of aboveground tanks reducing the need for extensive excavation and soil removal.

Figure 2:
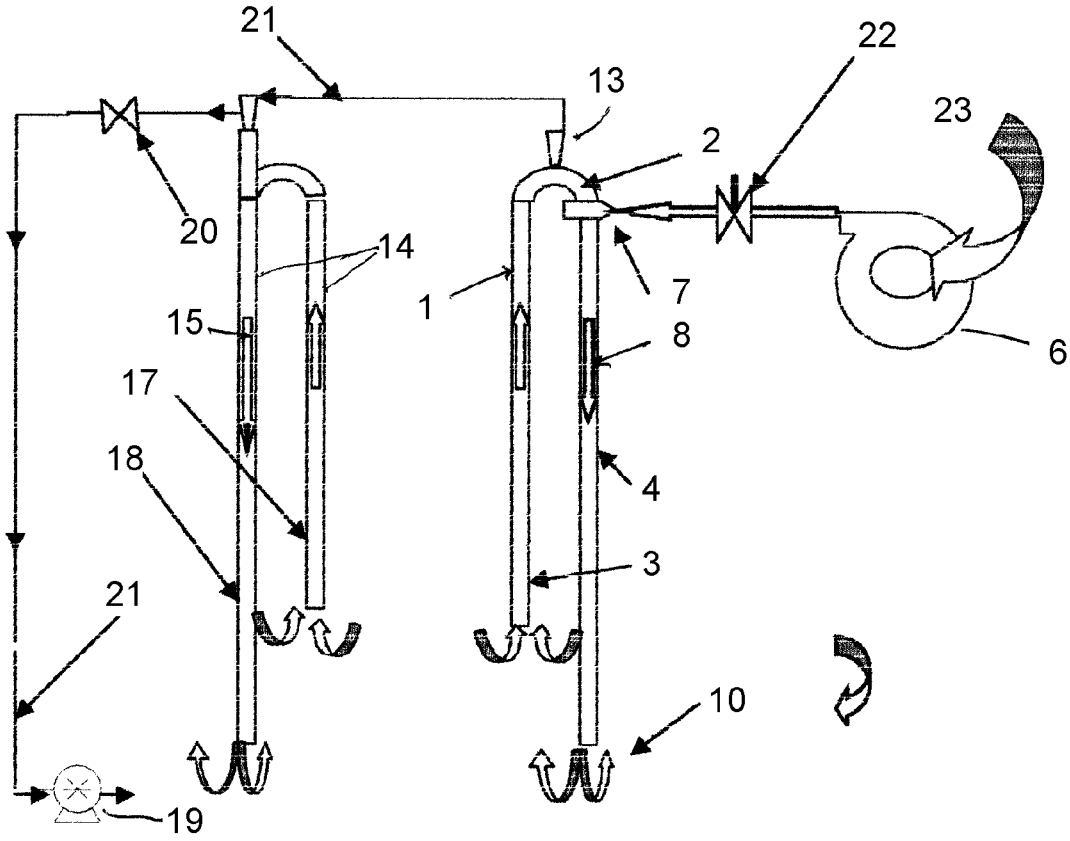
FIG. 2 Simplified flow diagram.
Figure 3:
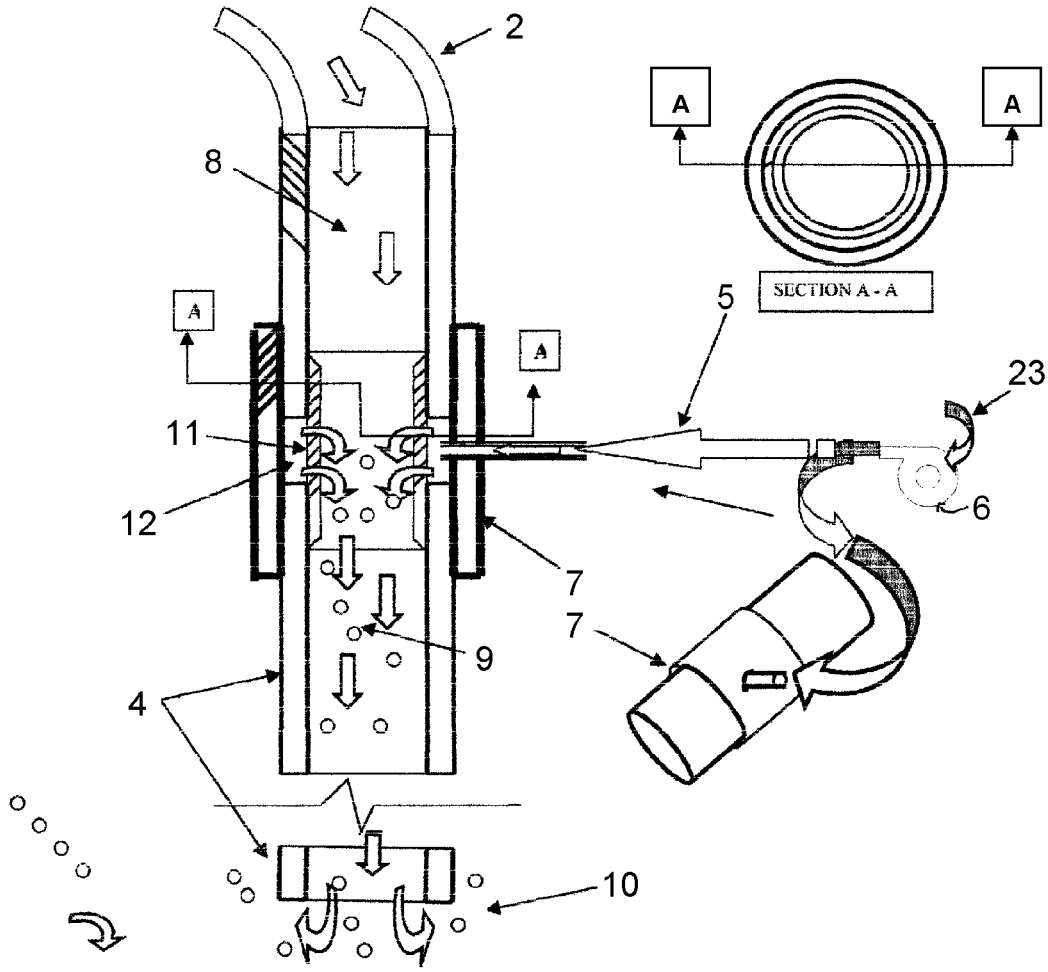
FIG. 3 Cross-section of a porous membrane type—reduced throat micro-bubble diffuser.
Figure 4:
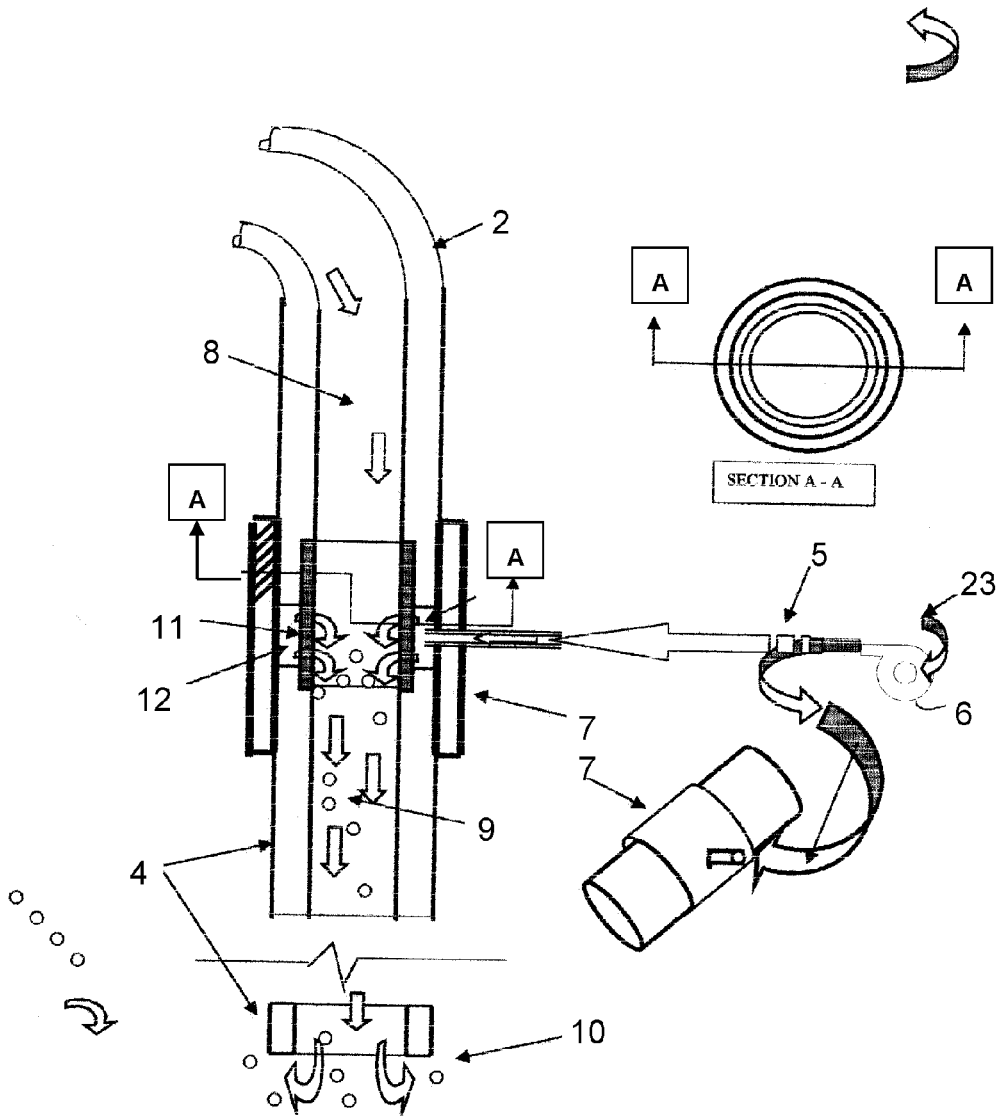
FIG. 4 Cross-section of a porous membrane type—full throat micro-bubble diffuser.
Figure 5:
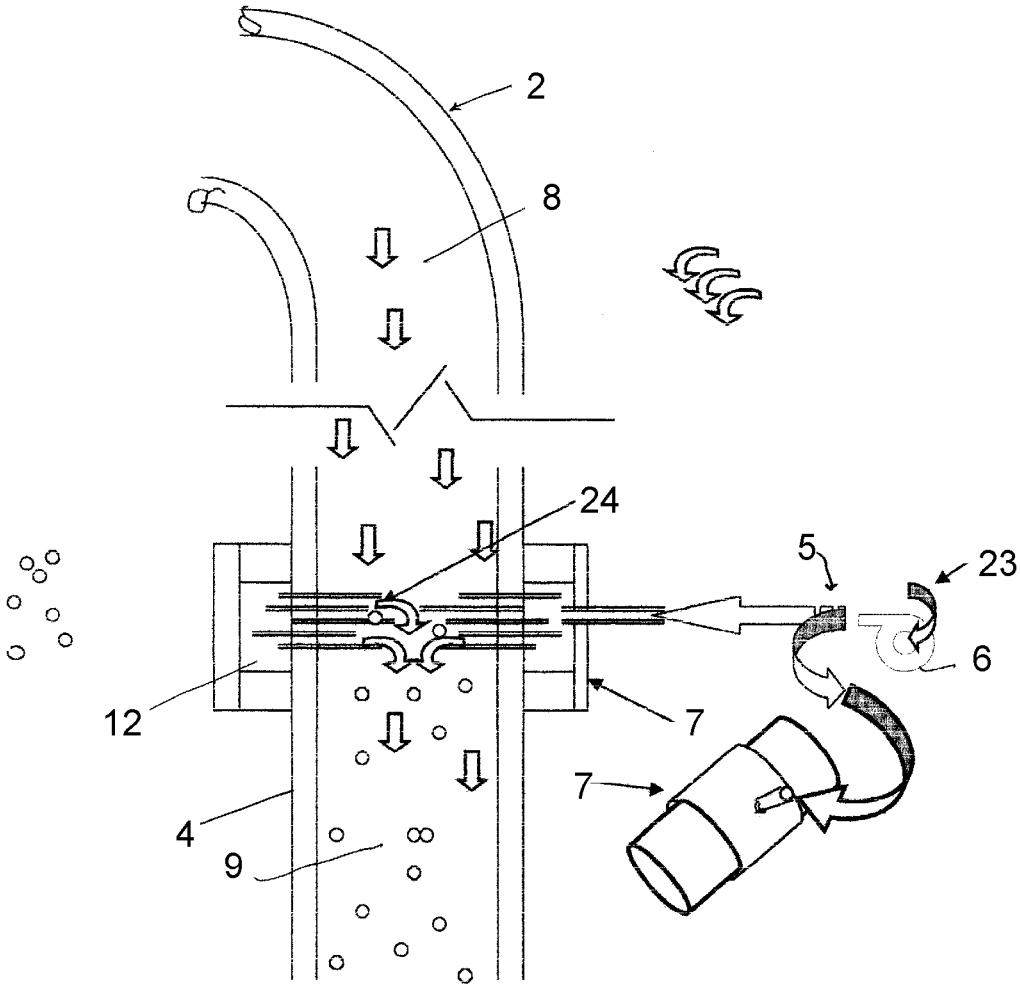
FIG. 5 Cross-section of a typical full throat micro-tube type micro-bubble diffuser.
Figure 6:
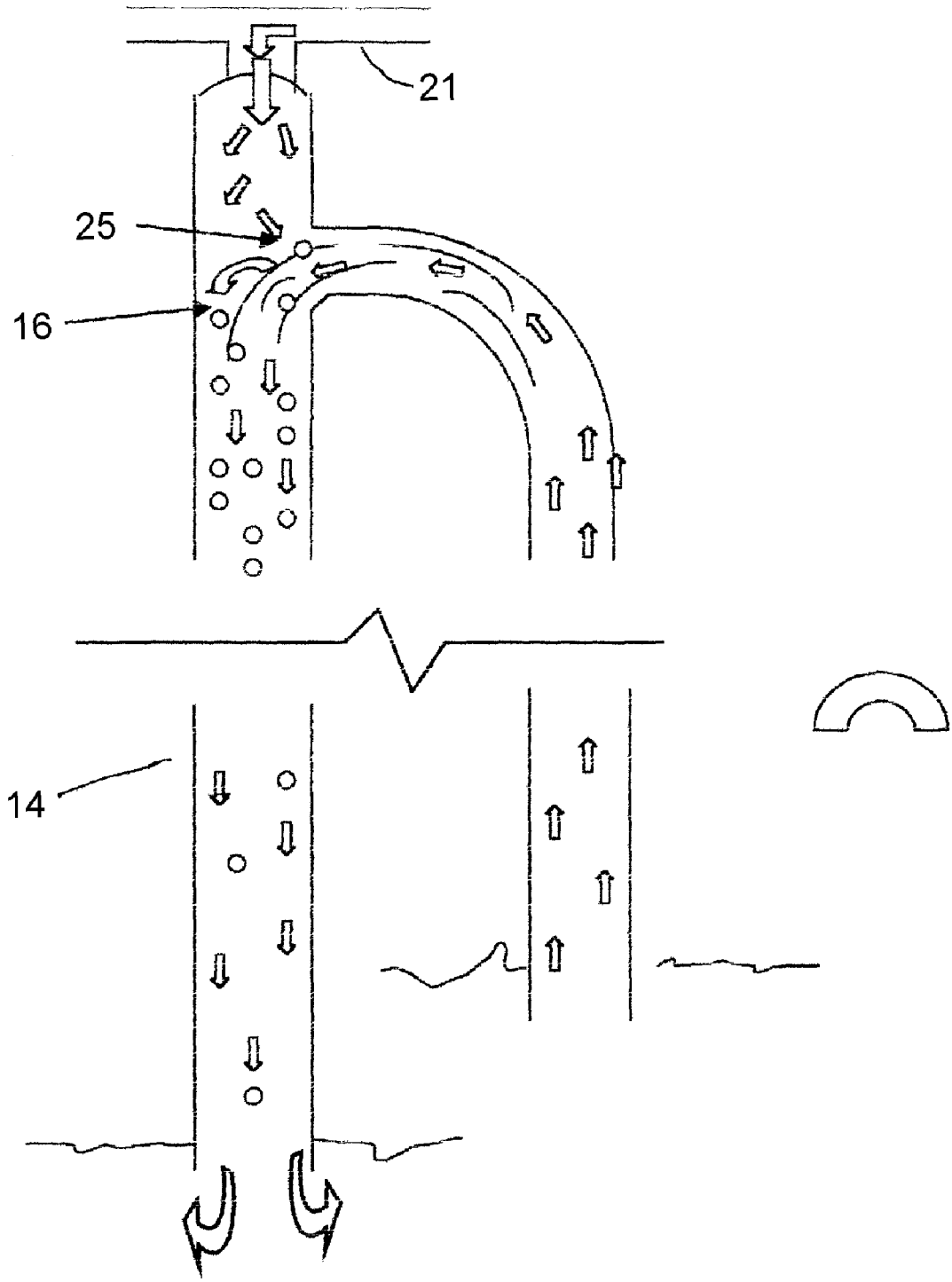
FIG. 6 Cross-section of any scavenger loop crossover header.

Basic components of an exemplary embodiment are shown In the FIG. 1. The basic system, shown in FIGS. 1 and 2, is based upon principles of a siphon 1, essentially an inverted U-tube having the lower ends of each U-tube submerged and each column filled with a flowing liquid. In FIG. 1, note the two different water levels (ELEVATED LIQUID LEVEL and LOWER LIQUID LEVEL) at the siphon inlets and discharge ends. As with any siphon, the more elevated the U-tube above the liquid surface, the greater the vacuum at the crossover header 2 connecting the uplift column 3 to the downflow column 4 to a maximum of 34 feet of water (1 atmosphere or 14.7 negative psia). Atmospheric air 23 after passing through a vacuum motor 6 is drawn via a micro-bubble diffuser 7 into the liquid 8 flowing downward in the downflow column 4. The micro bubbles 9 (shown in FIG. 5) emerging from the diffuser are dispersed in the downward flowing liquid 8 and transported to the downflow column 4 discharge point 10 (shown in FIGS. 3 and 4). Flowing liquid serves as a vehicle having inherent kinetic energy to sweep micro bubbles of air away from the porous membrane 11, as shown in FIGS. 3 and 4 (or micro-tubes 24, as shown in FIG. 6) into the downflowing liquid. The purpose of the micro-bubble diffuser 7 is to break up the air into micro bubbles as it is drawn from vacuum motor 6 through the circumferential air chamber 12 (shown in FIGS. 3 and 4) into the vacuum zone created by the siphon effect. The micro-bubble diffuser 7 is positioned as high as possible in the downflow column 4 without interfering with liquid flowing over from the uplift column 3 via the crossover header 2. The micro bubbles 9 formed by the micro-bubble diffuser 7 are purposely so small that they are easily swept down and away by the downflow current 8 before they can rise and interfere with the siphon 1 operation. A vent draw off connection 13 positioned at the top of the siphon crossover header 2 connects to the crossover header of the separate scavenger loop 15 (shown in FIG. 6).

The purpose of the scavenger loop 14 (shown in FIG. 6) is to remove any air and/or gases before they can collect and form pockets in the siphon column crossover header 2. The air and/or gases, if allowed to accumulate in the crossover header 2, could interfere with the liquid flow between the uplift column 3 and downflow column 4, and eventually disrupt the siphon effect. The scavenger loop is an integral part of the embodiment designed to insure uninterrupted operation of the energy recovery process.

The scavenger loop 14 produces the vacuum necessary for removing air or gas accumulations from the crossover header 2. It also operates on the siphon principle using uplift column 17 and downflow column 18, except that the scavenger loop crossover header (see FIG. 6) is designed to produce a vacuum by entrapping air and/or gases 25 into cascading liquid 16 (see FIG. 6). The scavenger loop 14 is independent of individual uplift and downflow column operation. This enables a single scavenger column to service multiple siphon crossover headers 2.

The system is started by vacuum priming using an external vacuum source 19. All air and/or gases are removed from the system during the priming phase. Once all siphon columns including the scavenger columns have been evacuated and air and/or gas is displaced by flowing liquid in the columns, the vacuum priming source 19 is shut down. A check valve 20 in the vacuum priming line 21 prevents air from back streaming once the vacuum source ceases operation. When the priming phase is complete, and system steady state flow in all columns as been established, energy recovery can then begin.

The energy recovery phase is entered into by opening the vacuum motor startup valve 22 in the flow line 5 between the vacuum motor and the connection to the micro bubble diffuser 7 in the downflow column. With this valve 22 in the open position, air will be drawn through the micro-bubble diffuser (s) 7 into the downflow column(s) 4. The vacuum motor will immediately start once atmospheric air 23 begins passing through.

I claim:

1. A vacuum activated closed loop system for creating a vacuum by harvesting the pressure differential of rapidly flowing liquid in a siphon, said system comprising:

a) an uplift column, further comprising a top and a bottom, through which liquid flows in an upward direction;

b) a downflow column, further comprising a top and a bottom, through which liquid flows in a downward direction;

c) a main loop crossover header, further comprising a top, joining the uplift column to the downflow column, and positioned between the top of the uplift column and the top of the downflow column through which liquid flows from the uplift column to the downflow column;

d) a micro-bubble diffuser located in the downflow column extending into the liquid flowing in the downward direction;

said diffuser comprises: an inlet passing through an outer wall of said diffuser, the outer wall of said diffuser surrounding an outer wall of said downflow column, a plurality of individual separate microtubes passing through the outerwall and an inner wall of said downflow column, said microtubes being perpendicular to a flow path within the downflow column, the microtubes each comprising an outermost end, each outermost end being spaced away from the inner wall of the downflow column in a staggered manner, the outermost ends located within and parallel to the flow path within the downflow column, the outermost end releasing bubbles into the flow path;

e) a priming system which fills the uplift and downflow columns with liquid to initiate the flow of liquid in the siphon; and f) at least one scavenger loop each of which comprises:

i) a scavenger downflow column, further comprising a top and a bottom, through which liquid flows in the downward direction;

ii) a scavenger loop crossover header, further comprising a top, attached to the top of the scavenger downflow column, wherein liquid flows through the scavenger loop crossover header to the downflow column, and wherein the liquid enters the scavenger loop crossover header at a point below the top of said scavenger loop crossover header, such that gas accumulates in the scavenger loop crossover header below the top of the scavenger loop crossover header; and iii) a conduit that connects the top of the main loop crossover header to the top of the scavenger loop crossover header.

2. The system of claim 1 wherein the priming system comprises a vacuum pump.

3. The system of claim 2 wherein the priming system accesses the uplift column at the top of the connector.

4. The system of claim 1 wherein the micro-bubble diffuser comprises the plurality of microtubes have diameters less than or equal to ten microns.

5. The system of claim 4 wherein the microtubes are flexible so as to bend toward the direction of the liquid flowing in the downward direction.

6. The system of claim 1 wherein the scavenger loop crossover header is attached to the top of the uplift column through which liquid flows in the upward direction.

7. The system of claim 1 wherein the at least one scavenger loop further comprises a scavenger uplift column that additionally comprises a top and a bottom, wherein the scavenger loop crossover header joins the top of the scavenger uplift column to the top of the scavenger downflow column.

* * * * *